United States Patent [19]

Karrip et al.

[11] 4,214,726

[45] Jul. 29, 1980

[54] CHAIR CONTROL

[75] Inventors: Alexander A. Karrip, Grand Rapids; Jack R. Knoblauch, Byron Center; Charles C. Pergler, Grand Rapids; Donald D. Korell, Ada, all of Mich.

[73] Assignee: Steelcase, Inc., Grand Rapids, Mich.

[21] Appl. No.: 957,748

[22] Filed: Nov. 6, 1978

[51] Int. Cl.[2] ..... A47C 3/026

[52] U.S. Cl. ..... 248/575; 297/302; 297/304; 248/597

[58] Field of Search ..... 248/575, 582, 597; 297/300–304, 306; 85/9 R

[56] References Cited

U.S. PATENT DOCUMENTS

| | | | |
|---|---|---|---|
| 623,008 | 4/1899 | Greb et al. | 248/597 |
| 1,570,436 | 1/1926 | Dawson | 248/597 |
| 1,986,105 | 1/1935 | Foote | 297/306 |
| 2,818,911 | 1/1958 | Syak | 248/575 |
| 2,845,991 | 8/1958 | Soderberg | 248/575 |
| 3,339,973 | 9/1967 | Doerner | 297/300 |
| 3,693,495 | 9/1972 | Wagner | 85/9 R |
| 3,740,792 | 6/1973 | Werner | 297/304 |
| 3,863,982 | 4/1975 | Sandham | 297/302 |
| 4,077,596 | 3/1978 | Pinaire et al. | 248/575 |

*Primary Examiner*—Francis K. Zugel

*Attorney, Agent, or Firm*—Price, Heneveld, Huiznega & Cooper

[57] ABSTRACT

The specification discloses a chair control employing an open top, generally rectangular drawn cup for housing an energy storage package. An axle secured to and extending between stretchers which are secured to a tilting chair or member thereof, is journaled in the drawn cup and carries the energy storage package. Means for adjusting the preload of the energy package and reducing the likelihood of an energy package failure are provided. First and second interlocking spindle support members are provided which form a cup reinforcing and stress distributing structure roughly box-shaped in cross section. The four outside corners of the cup are strengthened by indented sidewall portions. A strengthening flange is disposed about the periphery of the cup and the axle journaled in the cup, has a relatively large diameter for distributing stress.

28 Claims, 9 Drawing Figures

CHAIR CONTROL

BACKGROUND OF THE INVENTION

The present invention relates generally to chair controls or chair irons for tilting chairs or tilting components of chairs. More particularly, the invention is directed to a chair control achieving utmost simplicity, neatness, compactness, reliability, and cost savings.

In a tilting chair the seat and back are firmly fastened together and the seat is mounted on a base providing pivotable movement. Tilting movement is supplied by a chair control disposed between the base and the chair seat. An energy package in the chair control resists backward tilting of the chair to effectively spring bias the chair in a generally upright position. Other types of chairs employing a chair control have stationary and tilting chair members. An example of such a chair is a secretarial chair having a chair back mounted for backward tilting movement relative to the seat. In this case the chair control spring biases the chair back into a generally upright position.

In general, these prior art chair controls suffer from a number of common disadvantages. In the prior art, the internal workings of the chair control are in the open and in many cases the stationary and pivoting frame members are relatively complex structures interconnected by a plurality of rivets and bolts. The extra work required when bolts and rivets are used for assembly of this type of structure slows the operation and materially adds to the cost of manufacture. Furthermore, the fact that the internal workings of the chair control, and in particular, the energy package are in the open present several problems. This type of open design presents a cluttered appearance, presents the possibility of pinching or catching material in the energy package and in general serve as a settling place for debris.

Attempts to at least partially enclose the internal workings of the chair control are found in the prior art. However, these prior art chair controls have always employed cast iron housings or folded enclosures. Cast iron enclosures are heavy, relatively expensive to manufacture and casting tolerances are not good. Folded enclosures generally enclose no more than three sides of the chair control, and are made of relatively thick metal in order to withstand the relatively high stresses imposed on the chair control. Use of relatively thick metal for the folded enclosure adds to the cost of manufacturing these types of chair controls. Such structures are difficult to fold and weld, and waste much of the sheet material from which they are formed. Also, the tolerances achieved with folded enclosures are still not high, and a relatively complex chair control is presented with many internal workings still exposed.

Another problem with prior art chair controls involves free-fall of the tilting chair member against its stops upon failure of the energy package or an associated component. Often this free-fall backward into the tilted position is violent enough to tip the chair backward and endanger the occupant.

SUMMARY OF THE INVENTION

The present invention solves these and other problems with prior art chair controls by provision of an open top, generally rectangular, drawn metal cup for housing the internal workings of the chair control. The problem of providing a relatively thin drawn metal cup with sufficient strength to withstand the stresses normally imposed on a chair control is solved by a combination of features. These features include the inherent strength and stiffness of a rectangular or box-shaped structure and provision of means for securing a base structure to the housing and evenly distributing stress to the walls of the housing. The housing also includes means for journaling a tilting chair member about the housing.

In more narrow aspects of the invention, the means for securing a base structure to the housing and evenly distributing stress to the walls of the housing comprises first and second interlocking spindle support members. The support members forming a cup reinforcing structure roughly box-shaped in cross section. This box-shaped spindle securing structure serves to transmit and evenly distribute forces from the stationary chair structure to four of the five walls of the drawn housing. Additionally this structure, because of its box-shape serves to materially strengthen the cup. The means for journaling a tilting chair member about the housing comprises first and second stretchers for securing the chair control to a tilting chair or tilting chair section. An axle is secured to both stretchers and extends therebetween. The axle is journaled in the drawn cup such that the tilting chair member is pivotable about the cup. The energy storage package spring biases the tilting chair member in a generally upright position. A relatively large diameter axle is journaled in the cup, to more evenly distribute the load of the axle on the drawn cup. The four outside corners of the cup are reinforced by indented sidewall portions interconnecting two sides of the cup in each outside corner. The cup is further strengthened by a flange disposed about the periphery of the cup. The flange also serves as a mounting platform for stop means defining the arc of travel of the tilting chair member.

DESCRIPTION OF THE PREFERRED EMBODIMENTS

Figure 1:
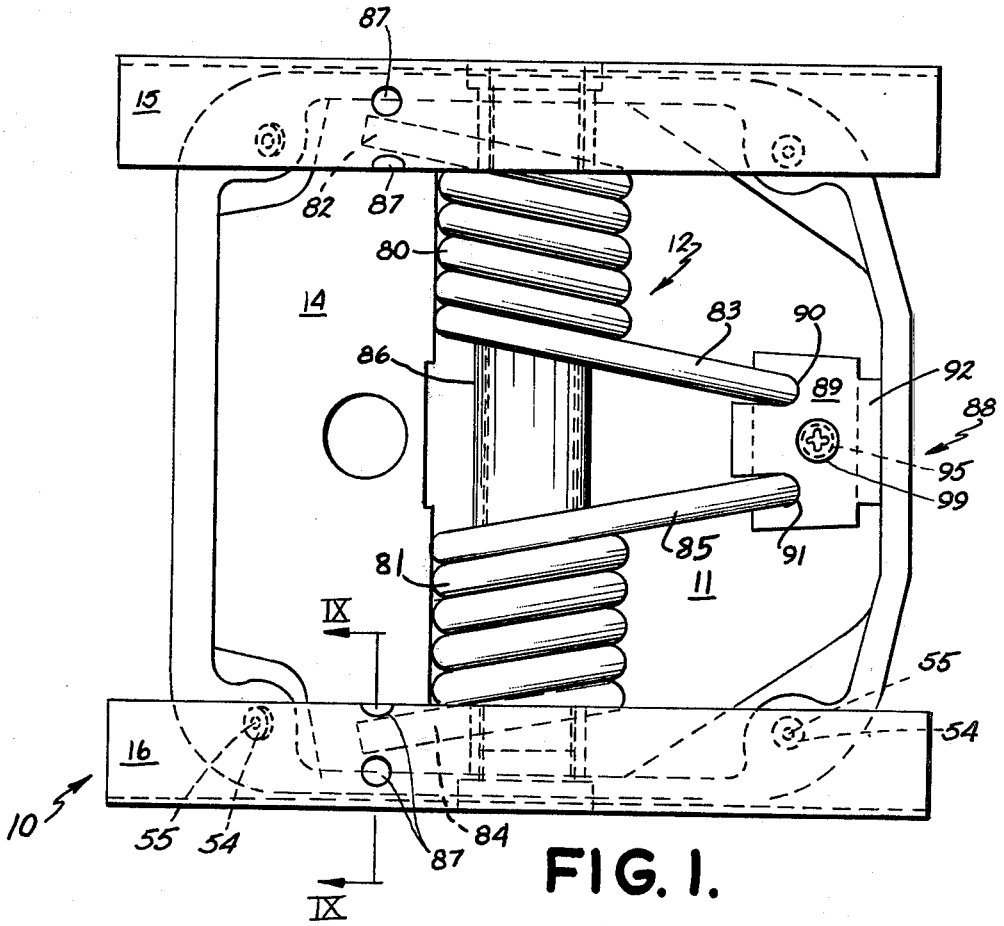
FIG. 1 is a top view of a chair control constructed according to the present invention.
Figure 2:
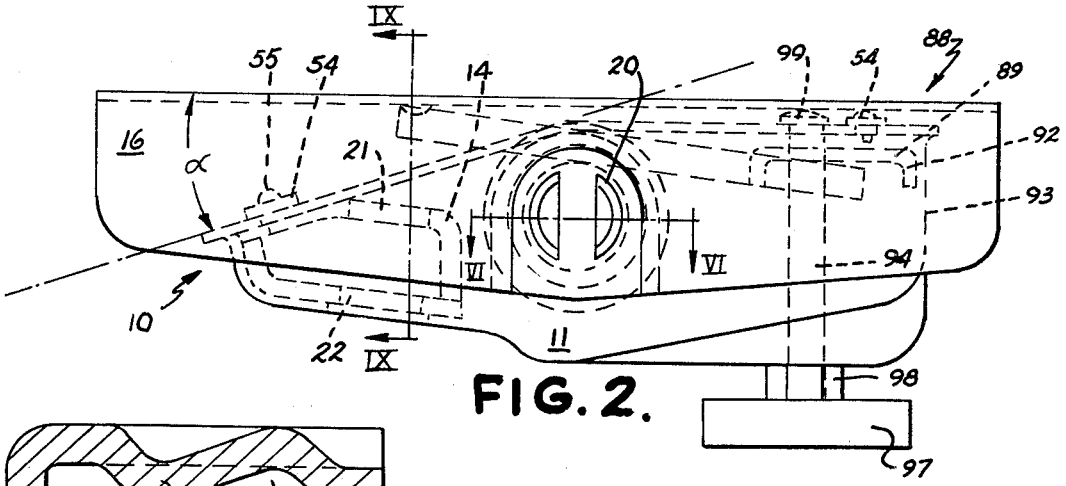
FIG. 2 is a side view of a chair control constructed according to the present invention.

Referring to FIGS. 1 and 2, a chair control or chair iron constructed according to the present invention is illustrated. The chair control generally indicated by the numeral 10 comprises an open top, generally rectangular, drawn cup 11 for housing an energy storage package generally indicated by the numeral 12. Means for securing a base structure to the cup 11 and evenly distributing stress to the walls of the cup 11 is disposed at 14. First and second stretchers 15 and 16 respectively, are disposed on opposite sides of the cup 11. The stretchers 15 and 16 secure the chair control to a tilting chair member. An axle 20 is secured to and extends between stretchers 15 and 16, the axle being journaled in the drawn cup 11.

The present embodiment of the invention is particularly adapted for use as a tilting chair control. In a tilting chair, the seat and back are firmly fastened together and the chair is mounted on a base providing pivotable movement. The chair control 10 is disposed between the base and the chair, providing backward movement and effectively spring biasing the chair in a generally upright position. The means for securing the base to the cup 11 and evenly distributing stress to the walls of the cup disposed at 14 includes apertures 21 and 22 for receiving the spindle of a base structure. The stretchers such as the one illustrated at 16 are bolted or otherwise secured in a suitable manner to the underside of the chair seat. The tilting action of the chair results from rotation of the axle 20 journaled in the drawn cup 11. The energy package housed within the drawn cup 11 spring biases the stretchers to the generally horizontal position illustrated by the stretcher 16 in FIG. 2. Tilting of the chair backward rotates the stretchers 16 through an arc $\alpha$ illustrated in FIG. 2. Pivotable movement about a generally vertical axis is achieved through rotation of a base spindle inserted in apertures 21 and 22 and suitably secured thereto by staking, welding, or the like.

Alternately, the chair control of the present invention may be employed with a chair having stationary and tilting chair sections. An example of such a chair is a secretarial chair having a chair back which is mounted for backward tilting movement relative to the seat. In this case, the seat is fixed and forms part of the base structure and the seat back is held in a normal or upright position by the chair control 10. When applying the chair control 10 to a secretarial chair or the like, the rectangular drawn cup 11 is secured to the chair seat by a bolt or the like inserted through apertures 21 and 22. The tilting chair back is then secured to stretchers 15 and 16 to allow tilting movement of the chair back through the angle $\alpha$. The energy package contained in drawn cup 11 serves to spring bias stretchers and hence the chair back in a generally upright position.

Figure 5:
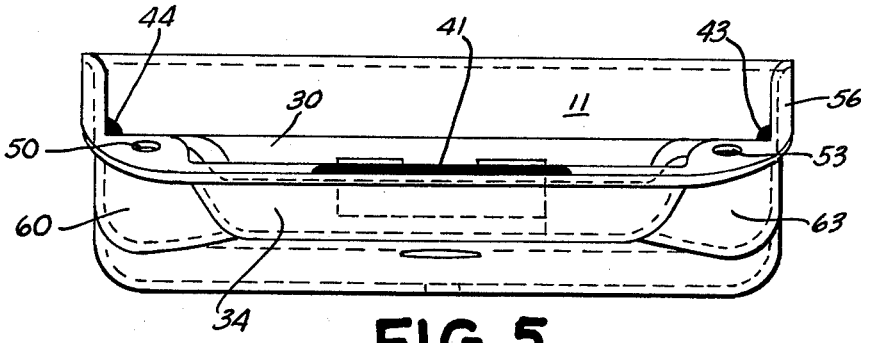
FIG. 5 is a rear view of a chair control housing constructed according to the present invention.
Figure 3:
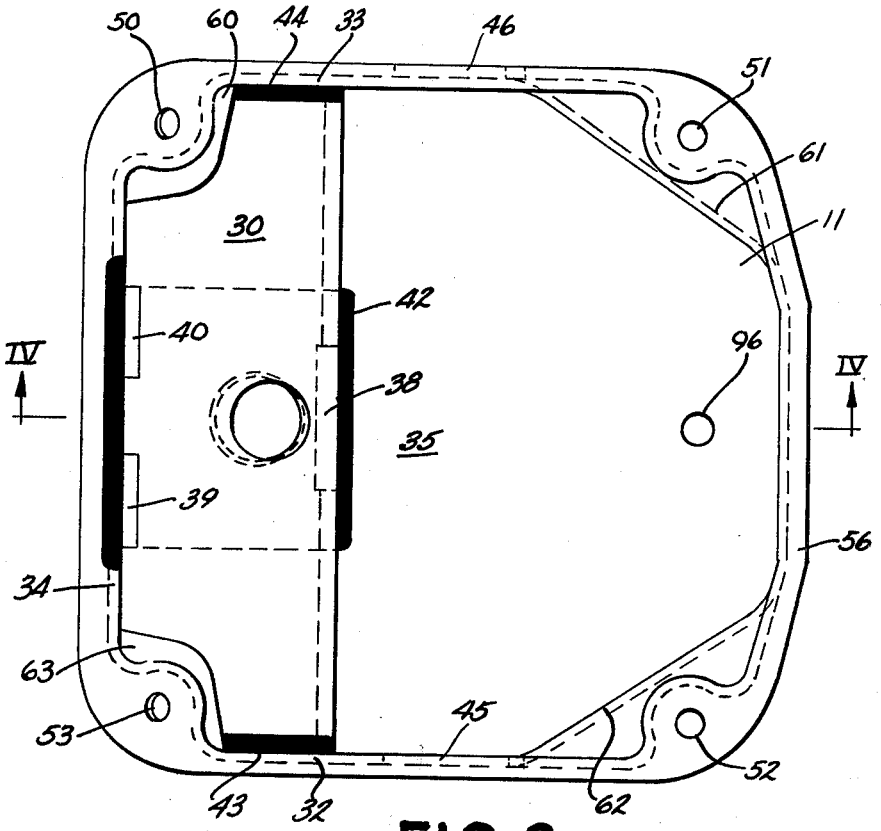
FIG. 3 is a top view of a chair control housing constructed according to the present invention.
Figure 4:
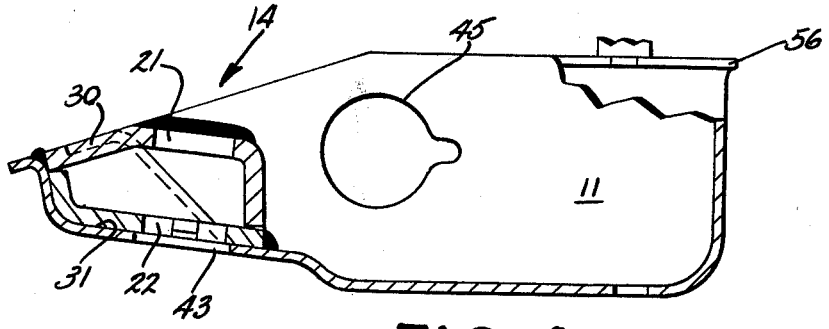
FIG. 4 is a side view, partially in section of a chair control housing constructed according to the present invention.

Many of the advantages that flow from the chair control of the present invention result from provision of an open top, generally rectangular drawn cup for housing the internal workings of the chair control. Referring now to FIGS. 3, 4, and 5, the drawn cup 11 is illustrated in further detail. Heretofore it has been thought impossible to employ relatively thin metal of the type used in a drawing process for housing the internal workings, and in particular, the energy package of a chair control because of the relatively high stresses imposed on the structural members of a chair control. According to the present invention the drawn cup 11 is suitably strengthened through a combination of features. To begin with, the overall shape of the cup lends to its strength. A five-sided rectangular structure is inherently stronger and stiffer than three and four-sided, folded structures constructed from the same material. Furthermore the means for securing the base to the cup and evenly distributing stress to the walls of the cup disposed at 14 comprises first and second interlocking spindle support members 30 and 31 which form a cup reinforcing and stress distributing structure roughly box-shaped in cross-section. As best illustrated in FIG. 3, the box-shaped cup reinforcing structure is welded to opposing sides 32 and 33 of the cup 11 and to a third side 34 and the bottom 35 of the cup 11. The box-shaped structure is in itself inherently stiff and by virtue of its widely distributed four point contact with the cup 11, serves to evenly distribute stresses from the spindle to the relatively thin drawn cup 11. The interlocking spindle support members 30 and 31 included mating tabs and slots at 38, 39 and 40, defining an interface between the support members disposed so that the support members 30 and 31 may be fused together and to the cup 11 with single welds disposed at 41 and 42. This greatly simplifies manufacturing procedures, since the cup 11 may simply be set in a jig or fixture having a spindle which protrudes through the opening 43 in the bottom of the cup. The interlocking spindle support members 30 and 31 may then be dropped over the spindle and secured there by gravity while welds 41 and 42 are applied. Welds at 43 and 44 secure the box-shaped reinforcing structure to opposing sides 32 and 33, respectively, of the drawn cup 11. Another advantage provided by the drawn cup is that the drawn cup can be easily manufactured to higher tolerances than folded structures.

The drawn cup 11 further includes means for journaling a tilting chair member about the cup. In this case, the means for journaling the tilting chair member comprises a pair of apertures 45 and 46 disposed in opposing sides 32 and 33, respectively, of the drawn cup 11. The apertures 45 and 46 receive a relatively large diameter axle 20 (best illustrated in FIG. 1) which contributes to the feasibility of the drawn cup design by serving to evenly distribute stresses transmitted to the cup from the tilting chair member. The diameter of axle 20 is approximately one inch, or larger.

The cup 11 further includes stop means disposed on the top four corners of the cup in apertures 50, 51, 52 and 53 (best illustrated in FIG. 3) for defining the arc of travel. The stop means fitted into these apertures comprises a plurality of plastic buttons 54 best illustrated in FIGS. 1 and 2. Preferably the buttons 54 are formed of a urethane elastomer and include a centrally located projection 55. The buttons 54 prevent metal to metal contact between the stretchers 15 and 16 and the cup 11. The projections 55 provide a further cushioning effect to provide stop action which is initially soft but quickly firms. The buttons 54 are mounted on a flange 56 which extends about the periphery of the cup. In addition to providing a convenient mounting platform for the stop means, the flange 56 serves to additionally strengthen the cup and aids in tooling considerations. The four top corners of the cup in which apertures 50–53 are provided are further strengthened by indented sidewall portions 60, 61, 62 and 63 which each interconnect two sides of the cup below each of the top four corners of the cup. For example, the indented sidewall portion 60 disposed below aperture 50 interconnects sidewalls 33 and 34 of the cup 11.

Figure 7:
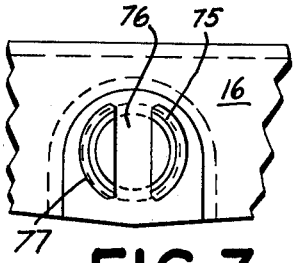
FIG. 7 is a detailed view of the end of an axle illustrating the manner of attachment to a stretcher.
Figure 6:
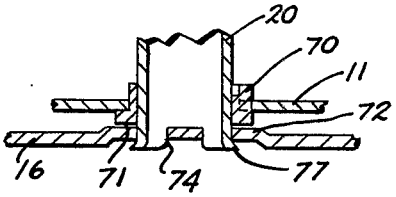
FIG. 6 is a sectional view taken along line VI—VI of FIG. 2.

Referring now to FIGS. 6 and 7, details regarding the journaling of axle 20 in cup 11 and securing axle 20 to stretchers 15 and 16 are further illustrated. The axle 20 is journaled in the drawn cup 11 with plastic bearing inserts such as the one illustrated at 70. The plastic bearing inserts are simply pressed into the cup 11 and mainly receive radial loading from the axle 20. However, the bearings 70 also include a thrust bearing face 71 that extends from the cup 11 to maintain appropriate spacing between the cup 11 and the stretchers 15 and 16. Spacing between cup 11 and the stretchers 15 and 16 sufficient to ensure clearance for the lip 56 extending about the periphery of the cup, is ensured by inwardly projecting embossed sections 72 on stretchers 15 and 16. The inwardly embossed sections 72 are disposed on the stretchers 15 and 16 at the point at which they are secured to axle 20, such that faces 71 of bearings 70 ride thereagainst. The embossed sections 72 reduce the thickness of the bearings required at 70 and thus reduce the cost of the bearings.

The ends of the axle 20 are slotted as illustrated at 74 and the stretchers 15 and 16 are provided with a webbed opening at 75 through which the ends of the axle project. The webbed opening 75 includes a web 76 which is aligned with the slots 74 provided on the end of axle 20. The axle 20 is conveniently secured to stretchers 15 and 16 by swagging of the ends of the axle as illustrated at 77. Since the swagged ends 77 of the axle 20 are surrounded by inwardly embossed section 72 of stretchers 15 and 16, the embossed section 72 serves to conveniently indent the swagged ends 77 of the axle 20, reducing the possibility of snagging fabric or scratching the occupant of the chair.

Referring now back to FIGS. 1 and 2, the energy package 12 housed within drawn cup 11 will be described in further detail. The energy package 12 may be characterized as a torsion coil spring type although it should be understood that with minor modifications other types of energy packages may be employed. For example, known types of energy packages that may be used with the present invention include rubber pack, coil spring, leaf spring, and torsion bar systems for storing energy. Rubber packs comprise a stationary support member and a tilting member interconnected by a web of resilient rubber. Coil spring systems may be of the torsion spring type or simple compression and tension type. Torsion coil springs may have the coil fixed with one or two tails of the coil deflected, or both tails of the coil may be fixed and the coil itself may be deflected. With simple coil spring systems, energy is stored by simple compression and tension of a coil spring. Leaf spring systems include cantilever and beam loaded energy storing members. Torsion bar systems may be fixed at one end with a moment applied to the opposite end or maybe fixed at both ends with a moment applied to the center of the torsion bar.

Figure 9:
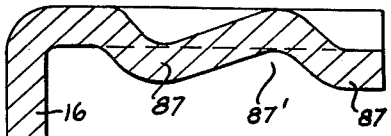
FIG. 9 is a fractional sectional view of a stretcher taken along line IX—IX of FIGS. 1 and 2.

In the preferred embodiment, two coils springs 80 and 81 are provided. Coil spring 80 includes tails 82 and 83 and coil spring 81 includes tails 84 and 85. The coil springs 80 and 81 are carried by axle 20 which fixes the position of the coils in the drawn cup 11 and prevents eccentric deflection of the coil springs when torsionally loaded. A protective plastic sleeve 86 is disposed between the axle 20 and the springs 80 and 81. The plastic sleeve 86 prevents metal to metal contact between the springs and the axle, improving the feel and sound of the chair control as well as lengthening the life of the springs. Tails 82 and 84 of coil springs 80 and 81 rest under stretchers 15 and 16, respectively, and are provided with a sufficient torsional preload to urge the stretchers 15 and 16 in the generally horizontal position illustrated by the stretcher 16 in FIG. 2. As best illustrated in FIGS. 1 and 9, the stretchers 15 and 16 include spring locators 87 formed integrally with the stretchers at a significant manufacturing and cost advantage. The spring locators 87 are stamped, punched or otherwise suitably formed in the stretchers and the spring tails 82 and 84 are retained therebetween in the area generally indicated at 87'. The tails 83 and 85 on the opposite ends of the coils 80 and 81 respectively, are caught by means for adjusting the preload of the coils 80 and 81, generally indicated at 88.

The means for adjusting the preload of the energy package comprises a bracket 89, including notches 90 and 91 through which the tails 83 and 85 of coil springs 80 and 81 project, resting under bracket 89. The bracket 89 is vertically adjustable to vary the preload of springs 80 and 81. The bracket 89 includes a flange 92 which slides along vertical wall 93 of the drawn cup 11 to guide vertical movement of the bracket 89. A threaded adjustment rod or bolt 94 (best illustrated in FIG. 8) engages threaded aperture 95 in bracket 89. The bottom of the drawn cup 11 includes an aperture 96 best illustrated in FIG. 3. The threaded adjustment rod includes a handle 97 including a first circumferential shoulder 98. The threaded adjustment rod 94 is inserted through aperture 96 in drawn cup 11 and threadably engages bracket 89 to vertically adjust the bracket 89 within drawn cup 11 by rotation of handle 97. A retaining screw 99 is threadably received in an axially extending aperture 99' disposed on the end of adjustment rod 94. The retaining screw 99 prevents the bracket 89 from backing off of the adjustment rod 99 at the minimum preload adjustment.

Provision of dual coil springs 80 and 81 in combination with the means for adjusting the preload of the coil springs generally indicated at 88 provides an added safety factor in the case of energy package failure. For example, if one of the two coil springs 80 and 81 were to fail, the bracket 89, although eccentrically loaded would still be sufficiently supported by threaded adjustment rod 94 and guided by rearwall 93 to ensure that the tail of the remaining coil spring will remain under bracket 89 preventing a complete energy package failure.

Figure 8:
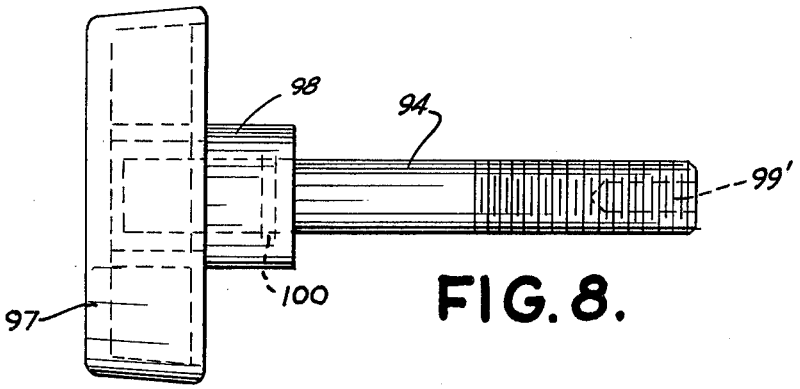
FIG. 8 is a plane view of an adjustment rod constructed according to the present invention.

Referring now specifically to FIG. 8, threaded adjustment rod 94 is illustrated in further detail. The handle 97 and first circumferential shoulder 98 of threaded adjustment rod 94 are normally made of plastic, or the like, cast on threaded rod 94. This is the conventional manner of constructing threaded adjustment rods. However, with conventional adjustment rods, upon failure of the plastic handle 97, the first circumferential shoulder 98 disintegrates, releasing the adjustment rod and causing a total energy package failure. In the prior art, this provides a potentially dangerous situation, since upon energy package failure, the chair will free-fall through the angle $\alpha$, against its rear stops. Since the angle $\alpha$ is normally on the order of 18 or 20 degrees, often this free-fall is sufficient to overturn the chair and endanger the occupant. However, according to the present invention, the threaded rod 94 includes means for reducing the likelihood of energy package failure comprising a second circumferential shoulder 100 disposed on threaded rod 94. The second circumferential shoulder 100 is formed from the base metal of threaded adjustment rod 94 and is disposed on the adjustment rod outside of drawn cup 11 and first circumferential shoulder 98. Thus, upon failure of the plastic handle 97, which causes disintegration of the first circumferential shoulder 98, the second circumferential shoulder 100 acts as a backup, preventing release of threaded adjustment rod 94. Since first and second circumferential shoulders 98 and 100 are disposed in close proximity on threaded adjustment rod 94, upon failure of the plastic handle 97, a free-fall of approximately three degrees will occur. Thus, the second shoulder 100 allows the use of a simple molded or cast plastic first shoulder and handle, decreasing the cost of the chair control and yet substantially reducing the probability of an energy package failure that could endanger the occupant upon failure of the plastic handle and first shoulder.

The above description should be considered as exemplary and that of the preferred embodiment only. The true spirit and scope of the present invention should be determined by reference to the appended claims. It is desired to include within the appended claims all such modifications of the invention that come within the proper scope of the invention.

The embodiments of the invention in which an exclusive property or privilege is claimed are defined as follows.

1. A housing for a chair control comprising:

an open top generally rectangular deep drawn cup having five sides for enclosing a torsional energy storage package;

means for securing a base structure to said cup and evenly distributing stresses to the walls of said cup comprising first and second generally L-shaped interlocking spindle support members, said support members being apertured for receiving a spindle and said support members forming a roughly box-shaped cup reinforcing structure welded to the bottom and three adjoining sidewalls of said cup; and means for journaling a tilting chair member about said cup.

2. The housing of claim 1 further including stop means disposed on the top four corners of said cup for defining an arc of travel of a tilting chair member journaled about said cup.

3. The housing of claim 2 further including means for strengthening the top four corners of said cup comprising an idented side wall portion interconnecting two sides of said cup below each of the four corners of said cup;

4. The housing of claim 2 further including a flange disposed about the periphery of said cup, said flange strengthening said cup and providing a mounting platform for said stop means in each of the top four corners of said cup.

5. The housing of claim 1 wherein said first and second interlocking spindle support members are provided with an interface between said support members disposed so that said support members are fused together and to said cup with a single weld.

6. The housing of claim 1 wherein said means for journaling a tilting chair member about said cup comprises first and second apertures on opposing sides of said cup for receiving a large diameter arbor.

7. The housing of claim 6 wherein said apertures are sized to receive an axle of approximately one inch in diameter, or larger.

8. The housing of claim 1 further including means for strengthening four of the corners of said cup comprising an indented sidewall portion interconnecting two sides of said cup below each of the top four corners of said cup.

9. The housing of claim 1 further including means for strengthening the periphery of said cup comprising a flange extending about the periphery of said cup.

10. A chair control comprising:

an open top generally rectangular deep drawn cup having five sides for enclosing a torsional energy storage package;

means for securing a base structure to said cup and evenly distributing stress from the base to the walls of said cup comprising first and second generally L-shaped interlocking spindle support members, said support members being apertured for receiving a spindle and said support members forming a roughly box-shaped cup reinforcing structure welded to the bottom and three adjoining sidewalls of said cup;

first and second stretchers for securing the chair control to a tilting chair member; and a relatively large axle for distributing stress from said chair to said cup, said axle being secured to and extending between said stretchers and said axle being journaled in opposing sidewalls of said drawn cup.

11. The chair control of claim 10 further including stop means disposed on the top four corners of said cup for defining an arc of travel of a tilting chair member journaled about said cup.

12. The chair control of claim 11 wherein said stop means comprise a plurality of elastomer buttons, said elastomer buttons each including an integrally formed projection for improving the feel of said stop means.

13. The chair control of claim 12 further including means for stengthening the top four corners of said cup comprising an indented sidewall portion interconnecting two sides of said cup below each of said four corners.

14. The chair control of claim 12 further including a flange disposed about the periphery of said cup, said flange strengthening said cup and providing a mounting platform for said stop means in each of the top four corners of said cup.

15. The housing of claim 10 wherein said first and second interlocking spindle support members are provided with an interface between said support members disposed so that said support members are fused together and to said cup with a single weld.

16. The chair control of claim 10 further including means for strengthening four of the corners of said cup comprising an indented sidewall portion interconnecting two sides of said cup below each of the top four corners of said cup.

17. The chair control of claim 10 further including means for strengthening the periphery of said cup comprising a flange extending about the periphery of said cup.

18. The chair control of claim 17 wherein said first and second stretchers are embossed at the points at which said axle is secured thereto to provide clearance for said flange.

19. The chair control of claim 10 wherein:

the ends of said axle are slotted;

said first and second stretchers are provided with webbed openings through which the ends of said axle project; and said axle is secured to said first and second stretchers by swagging the ends of said axle.

20. The chair control of claim 19 wherein said first and second stretchers are embossed at the points at which said axle is secured thereto to insert the swagged ends of said axle.

21. The chair control of claim 10 wherein said axle has a diameter of approximately one inch, or larger, to evenly distribute stress from the chair to the walls of said drawn cup.

22. The chair control of claim 10 further including means for adjusting the preload of an energy package and reducing the likelihood of an energy package failure.

23. The chair control of claim 10 further including an energy package comprising:

a pair of torsionally loaded coil springs, said coil springs encompassing said axle;

each of said coil springs including first and second tails; and said first tails resting under said first and second stretchers and said second tails being secured to said cup.

24. The chair control of claim 23 further including a plastic sleeve disposed between said coil springs and said axle for improving the feel of the chair control and reducing wear from metal to metal contact between said springs and said axle.

25. The chair control of claim 23 wherein said stretchers further include integrally formed spring locators comprising a pair of projections disposed on each stretcher, said first tails being centered therebetween.

26. The chair control of claim 23 further including means for adjusting the preload of said energy package comprising:

a bracket for catching said second tails and said bracket including a threaded bracket aperture;

a threaded adjustment rod engaging said bracket aperture;

a cup aperture disposed in said cup said adjustment rod extending therethrough;

a first circumferential shoulder disposed on said adjustment rod outside of said cup; and means for turning said adjustment rod to vary the preload of said energy package.

27. The chair control of claim 26 further including means for reducing the likelihood of an energy package failure comprising a second circumferential shoulder disposed on said adjacent rod outside of said cup and outside of said first circumferential shoulder.

28. The chair control of claim 22 wherein said means for adjusting the preload of an energy package and reducing the likelihood of energy package failure comprises:

a threaded bracket engaging an energy package for varying the preload of an energy package;

a threaded adjustment rod engaging said bracket for varying the position of said bracket and thus varying the preload of an energy package;

a plastic handle for facilitating rotation of said adjustment rod and for varying the position of said bracket with respect to an energy package structural support;

a first shoulder defined by said plastic handle for fixing the position of said adjustment rod with respect to an energy package housing; and a second metal shoulder defined by said adjustment rod, said plastic handle being cast therearound, said second metal shoulder serving to fix the position of said adjustment rod with respect to an energy package housing upon failure of said plastic handle, said second metal shoulder thereby preventing an energy package failure upon failure of said plastic handle.

* * * * *

UNITED STATES PATENT AND TRADEMARK OFFICE

CERTIFICATE OF CORRECTION

PATENT NO. : 4,214,726

DATED : July 29, 1980

INVENTOR(S) : Alexander A. Karrip, et al

It is certified that error appears in the above-identified patent and that said Letters Patent are hereby corrected as shown below:

Column 3, lines 31-46:

Delete paragraph

Column 7, line 39, claim 3:

"idented" should be --indented--

Column 10, line 8, claim 27:

"adjacent" should be --adjustment--

Signed and Sealed this

*Twenty-eighth* Day of *October 1980*

[SEAL]

*Attest:*

SIDNEY A. DIAMOND

*Attesting Officer*

*Commissioner of Patents and Trademarks*